US010065768B2

(12) United States Patent
Tseng et al.

(10) Patent No.: US 10,065,768 B2
(45) **Date of Patent: *Sep. 4, 2018**

(54) PLASTIC BAG WITH GRIP STRIP

(71) Applicant: Inteplast Group Corporation, Livingston, NJ (US)

(72) Inventors: Ben Tseng, Somerset, NJ (US); Ter-Hai Lin, Sugar Land, TX (US); Joe Wang, Roseland, NJ (US); Jerry Hsu, Closter, NJ (US)

(73) Assignee: Inteplast Group Corporation, Livingston, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/279,505

(22) Filed: Sep. 29, 2016

(65) Prior Publication Data

US 2017/0015470 A1 Jan. 19, 2017

Related U.S. Application Data

(63) Continuation of application No. 14/084,129, filed on Nov. 19, 2013, now Pat. No. 9,540,144.

(51) Int. Cl.
*B65D 33/00* (2006.01)

(52) U.S. Cl.
CPC ..... *B65D 33/007* (2013.01); *B65D 33/002* (2013.01)

(58) Field of Classification Search
CPC ..... B65D 33/02; B65D 33/30; B65D 33/002; B65D 33/007
USPC ..... 383/35
See application file for complete search history.

(56) References Cited

U.S. PATENT DOCUMENTS

| | | | |
|---|---|---|---|
| D29,594 | S | 11/1898 | Arkell |
| 3,250,825 | A | 5/1966 | Martinovich |
| 3,406,853 | A | 10/1968 | McLeod |
| 3,715,420 | A | 2/1973 | Kiyono et al. |
| 3,979,050 | A | 9/1976 | Cilia |
| 4,356,954 | A | 11/1982 | Mojonnier |
| 4,488,918 | A | 12/1984 | Jofs |
| 4,562,023 | A | 12/1985 | Pabst et al. |
| D285,412 | S | 9/1986 | Harwell, Jr. |
| 4,747,701 | A | 5/1988 | Perkins |
| 4,753,766 | A | 6/1988 | Pinsolle |
| 4,758,099 | A | 7/1988 | Branson |
| D297,306 | S | 8/1988 | King |
| 4,840,824 | A | 6/1989 | Davis |
| 4,904,092 | A | 2/1990 | Campbell et al. |
| 5,000,500 | A | 3/1991 | Almog |
| 5,308,666 | A | 5/1994 | Borchardt |
| D349,451 | S | 8/1994 | Sagnard |
| 5,382,094 | A | 1/1995 | Ausnit |
| D363,018 | S | 10/1995 | Stokes et al. |
| 5,706,961 | A | 1/1998 | Morano |
| 5,804,112 | A | 9/1998 | Greene |
| 5,863,130 | A | 1/1999 | Nguyen |
| 5,894,947 | A | 4/1999 | Marano |
| D429,459 | S | 8/2000 | Berman |
| D432,907 | S | 10/2000 | Hyde |
| 6,135,281 | A | 10/2000 | Simhaee |
| D476,225 | S | 6/2003 | De La Garza |
| 6,716,296 | B2 | 4/2004 | Chum |
| D541,669 | S | 5/2007 | Pokusa et al. |

(Continued)

*Primary Examiner* — Peter Helvey
(74) *Attorney, Agent, or Firm* — Senniger Powers LLP

(57) ABSTRACT

A plastic bag comprising a grip strip configured to assist with opening the bag, wherein the grip strip is formed from a material different from a material from which its associated panel is formed.

21 Claims, 14 Drawing Sheets

(56) References Cited

U.S. PATENT DOCUMENTS

| | | | |
|---|---|---|---|
| D552,482 | S | 10/2007 | Lin |
| 7,381,357 | B2 | 6/2008 | Cramer |
| D586,232 | S | 2/2009 | Friebe et al. |
| D634,645 | S | 3/2011 | LaFauci et al. |
| 7,950,851 | B2 | 5/2011 | Taheri |
| D642,069 | S | 7/2011 | LaFauci et al. |
| D676,762 | S | 2/2013 | LaFauci |
| 8,389,596 | B2 | 3/2013 | Boyce et al. |
| 8,469,592 | B2 | 6/2013 | Pawloski |
| D688,564 | S | 8/2013 | LaFauci |
| D691,491 | S | 10/2013 | Tucker et al. |
| 8,568,031 | B2 | 10/2013 | Price et al. |
| D694,651 | S | 12/2013 | Sam |
| 8,689,526 | B2 | 4/2014 | Rabiea |
| 8,979,367 | B2 | 3/2015 | Tan |
| 2003/0077007 | A1 | 4/2003 | Turvey et al. |
| 2003/0138171 | A1 | 7/2003 | Kikuchi |
| 2004/0184682 | A1 | 9/2004 | Lovold |
| 2004/0234171 | A1 | 11/2004 | Dais et al. |
| 2005/0281489 | A1 | 12/2005 | Yeh et al. |
| 2011/0211777 | A1 | 9/2011 | Gerbault |
| 2011/0249919 | A1 | 10/2011 | Shepard |
| 2011/0311168 | A1 | 12/2011 | Pawloski |
| 2011/0311169 | A1 | 12/2011 | Smith et al. |
| 2012/0180434 | A1 | 7/2012 | Snyder et al. |
| 2012/0195526 | A1 | 8/2012 | Moehlenbrock et al. |
| 2013/0223766 | A1 | 8/2013 | Gebhardt |
| 2013/0236129 | A1 | 9/2013 | Pawloski |
| 2014/0093192 | A1 | 4/2014 | Dais et al. |

PLASTIC BAG WITH GRIP STRIP

REFERENCE TO RELATED APPLICATION

This application is a continuation of U.S. application Ser. No. 14/084,129 filed Nov. 19, 2013, the entire disclosure of which is expressly incorporated herein by reference.

FIELD OF THE INVENTION

The present invention generally relates to plastic bags, and more specifically, a plastic bag that includes a grip strip.

BACKGROUND OF THE INVENTION

Plastic bags made of high density polyethylene (HDPE) are used in many different settings, such as supermarkets, department stores, and similar applications. The plastic bags may be dispensed from flat packs or may be wound on rolls. The bags made of thin, flexible HDPE films tend to be very difficult to open because HDPE film has a very low surface coefficient of friction (COF). The front and rear panels of the plastic bag often stick or cling to each other, making it difficult for a customer to identify the opening of the bag and to separate the front and rear panels to open the bag due to the low COF of the film. Thus, it would be beneficial to have a plastic bag configured for easy opening.

Several attempts have been made to provide easy opening for bags. For example, U.S. Pat. No. 5,894,947 uses embossment or piercing to enhance gripping. However, embossment or piercing weakens the strength of the film. U.S. Publication 2003/0138171 uses a non-slip coating, a zipper with a co-extruded flange, or embossment. However, applying a coating is an extra process that adds to the time and cost to manufacture the bag, the co-extruded flange requires that the bag includes a special zipper, and, as already stated, embossment weakens the strength of the film. U.S. Pat. No. 7,950,851 uses rib profiles to enhance grip to tear a bag. However, extra materials are needed to form the raised ribs from the bag walls. Accordingly, it would be beneficial to have an improved plastic bag configured for easy opening.

SUMMARY OF THE INVENTION

In one aspect of the present invention, the invention is directed to a plastic bag comprising two panels wherein at least one of the panels has a grip strip configured to assist with opening the bag, wherein the grip strip is co-extruded with its associated panel and the grip strip is formed from a material different from a material from which its associated panel is formed.

The invention is also directed to a plastic having the above-described panels, edges, and opening and at least one grip strip having a coefficient of friction higher than a coefficient of friction of the panel, the at least one grip strip extending horizontally along the panel adjacent the top edge from the first side edge to the second side edge or, alternatively, the at least one grip strip extending vertically along the panel from the top edge to the bottom edge.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Referring to FIGS. 1-5, a plastic bag is shown generally at 10. The plastic bag 10 includes coextensive front and rear panels 12 and 14, respectively (broadly, first and second panels). The panels 12, 14 are joined at the bottom 16 and sides 18 of the bag 10. The bag 10 can be formed by extruding a tubular film (see FIG. 2), and the bottom of the tubular film sealed together to form the bag. Alternatively, the panels 12, 14 can be formed as a single sheet of material that is folded at the bottom of the bag 10 along a linear fold, and the sides edges joined together by fusion lines. The panels 12, 14 can be joined in other manners within the scope of this invention. For example, the panels may be formed as separate sheets and fused together along the bottom and side edges. Whether the panels are formed as a tubular film, formed as one piece and folded over, or formed as two pieces, the edges are considered to be "joined" together for purposes of this description. Furthermore, in some embodiments, the panels 12, 14 may not be coextensive. For example, the top of one of the panels can extend above the top of the other panel.

The bag 10 can be any suitable size for a particular application. For example, the bag 10 can be a narrow profile produce bag having a width in a range of about 12 inches to about 14 inches and a length in a range of about 18 inches to about 24 inches. Alternatively, the bag 10 can be a regular profile produce bag having a width in a range of about 10 inches to about 12 inches and a length in a range of about 15 inches to about 20 inches. The bag 10 can also be a t-shirt type bag having front and rear gusset panels and a cutout forming a pair of bag handles, the t-shirt type bag having a width in a range of about 7.5 inches to about 8 inches, a gusset in a range of about 5 inches to about 6.5 inches, and a length in a range of about 19.5 inches to about 24 inches. These examples are for illustration purposes only, as the bag 10 can be any size and configuration within the scope of the present invention.

Figure 1:
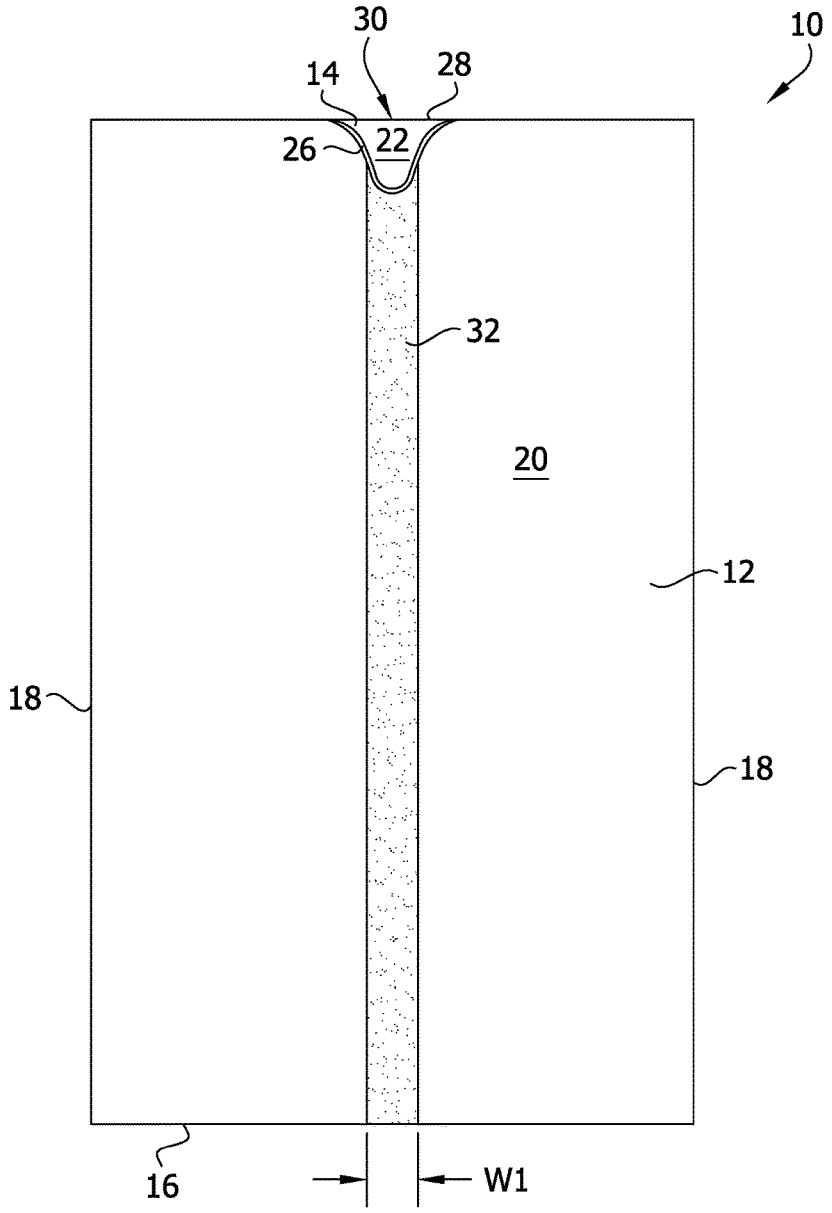
FIG. 1 is a front elevation of a plastic bag having a vertical grip strip according to an embodiment of the present invention, illustrating the front panel of the plastic bag as curled away from the rear panel for easy opening of the bag.
Figure 2:
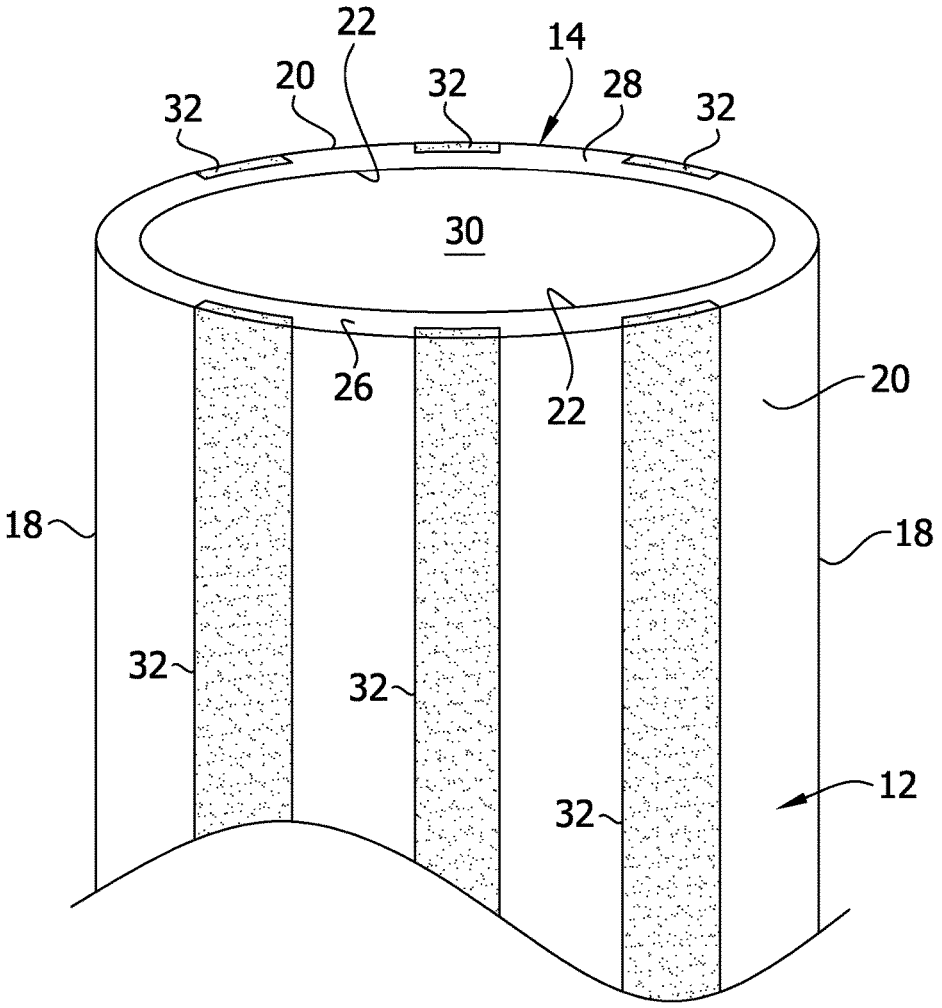
FIG. 2 is a fragmentary perspective of a plastic bag having a plurality of vertical grip strips according to an embodiment of the present invention.

The panels 12, 14 each have an outer surface 20 and an inner surface 22. The inner surfaces 22 of the joined panels 12, 14 define a bag interior 24 for receiving items placed in the bag 10. The top edges 26, 28 of the panels 12, 14 are unsecured along their length to define an opening 30 permitting access to the bag interior 24 and its contents. The top edge 26 of the panel 12 is illustrated in FIG. 1 as being curled away from the top edge 28 of the panel 14, as will be described in more detail below. The bag 10 includes a grip to facilitate movement of the panels 12, 14 with respect to each other for opening the bag. The grip can be any structure that permits gripping of the panels 12, 14 to open the bag 10, such as a co-extrusion of a sticky resin.

In the illustrated embodiment, the grip comprises a sticky or tacky grip strip 32. The grip strip 32 is a vertical strip that extends between the top edges 26, 28 of the panels 12, 14 and the bottom 16 of the bag 10. The strip 32 is relatively tacky or sticky as compared to the remainder of the bag 10, which is relatively smooth in comparison. The relatively smooth remainder of the bag 10 has a relatively low COF as compared to the grip strip 32, which has a higher COF to improve grip. As illustrated, at least one of the panels 12, 14 includes at least one strip 32 on the outer surface 20 of the panel. Each of the panels 12, 14 can include any desired number of grip strips. For example, each panel 12, 14 can include one strip 32 (see FIG. 1), two grip strips (see FIG. 5), three grip strips (see FIG. 2), or any other suitable number of grip strips. Each strip 32 preferably has a width W1 in a range of about 0.25 inches to about 5 inches, such as from about 0.5 inches to about 2.5 inches. If the panel includes multiple strips 32, the strips can be spaced from each other by a distance D1 in a range of about 1 inch to about 10 inches, such as from about 2 inches to about 5 inches.

In the illustrated embodiment, the first panel 12 has the same number of grip strips 32 as the second panel 14, and each strip on the first panel is aligned with a strip on the second panel. However, other configurations are within the scope of the present invention. For example, the panels 12, 14 can have different numbers of strips 32, the strips on the panels can be staggered from each other, or only one of the panels can include a strip or strips. As illustrated, each grip strip 32 extends along the entire height of the panels 12, 14 from the top edges 26, 28 to the bottom 16 of the bag 10. However, the vertical strip 32 may extend over only a portion of the height of the panels 12, 14 within the scope of the present invention. Preferably, the grip strip 32 extends to the top edges 26, 28 and is immediately adjacent the opening 30.

Figure 3:
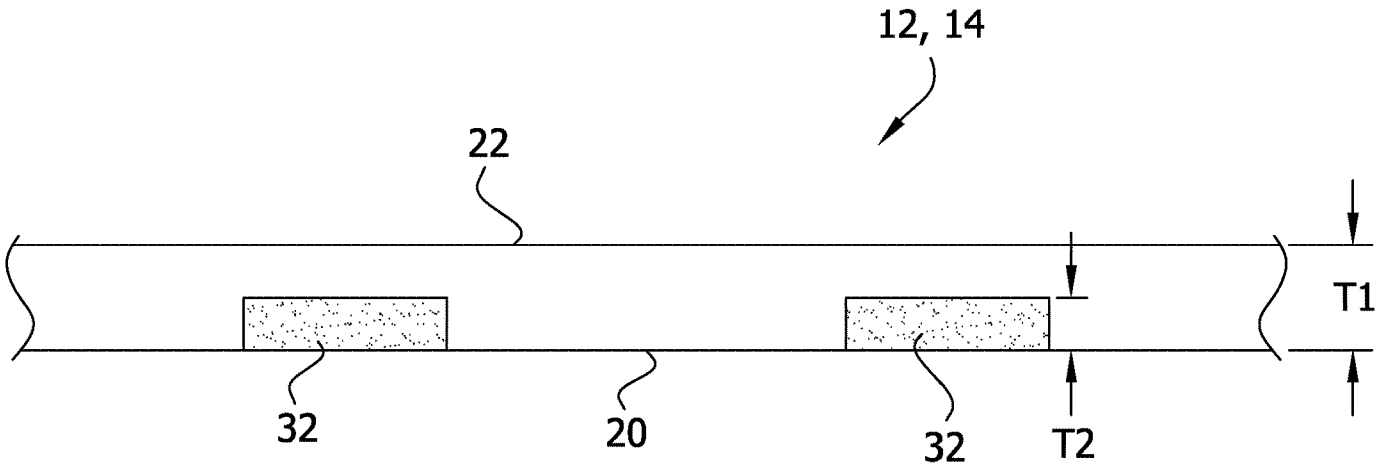
FIG. 3 is a fragmentary cross section of a panel of the plastic bag, illustrating the grip strip extending partially through a thickness of the panel.

As seen in FIG. 3, each grip strip 32 extends partially through a thickness T1 of each panel 12, 14. The grip strip 32 has a thickness T2 extending from the outer surface 20 toward the inner surface 22 of each panel 12, 14. In one embodiment, the thickness T1 is in a range of about 5 μm to about 20 μm, and the thickness T2 of the grip strip 32 is in a range of about 30% to about 90% of T1, such as between about 45% and about 75% of T1. In one embodiment, T1 is about 8 μm and T2 is about 5 μm.

Figure 6:
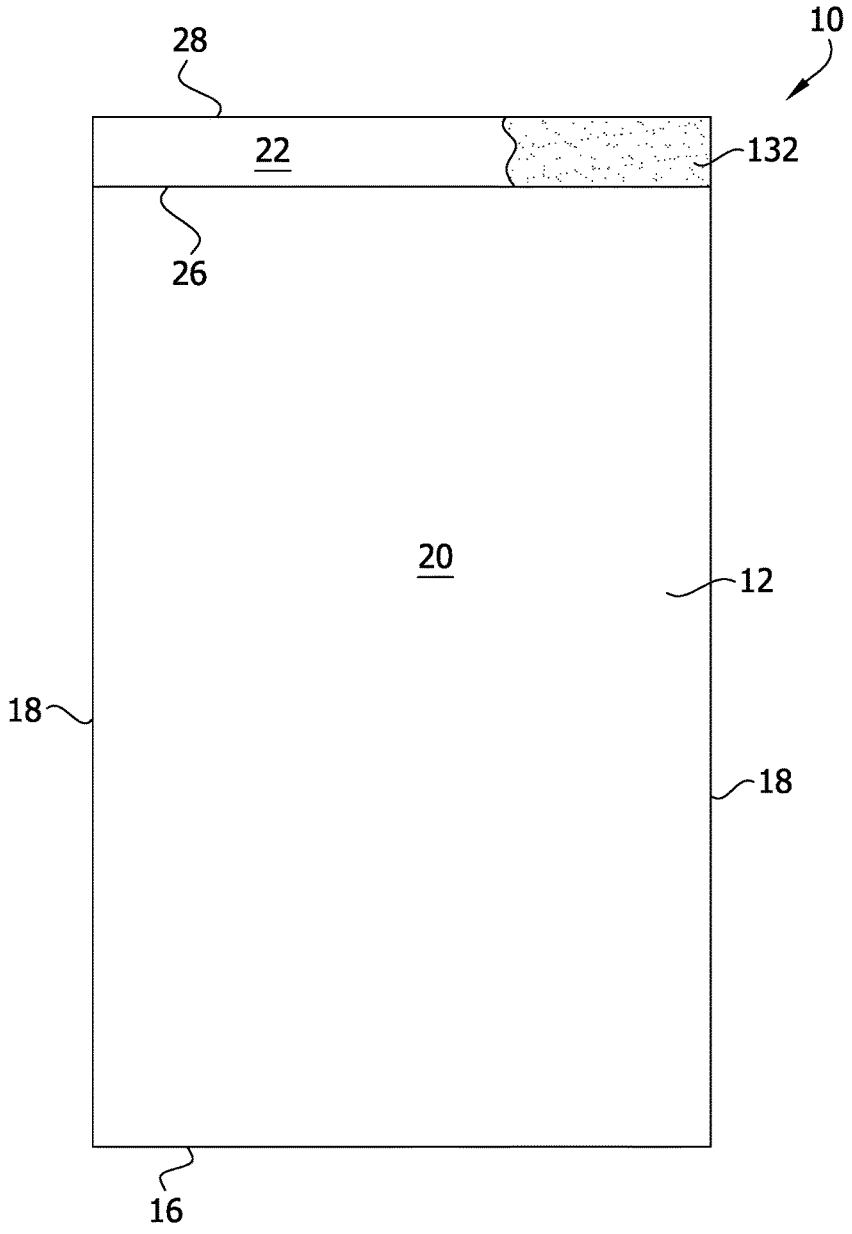
FIG. 6 is a front elevation of a plastic bag having a horizontal grip strip according to an embodiment of the present invention, illustrating a portion of the front panel of the plastic bag as curled away from the rear panel for easy opening of the bag.
Figure 7:
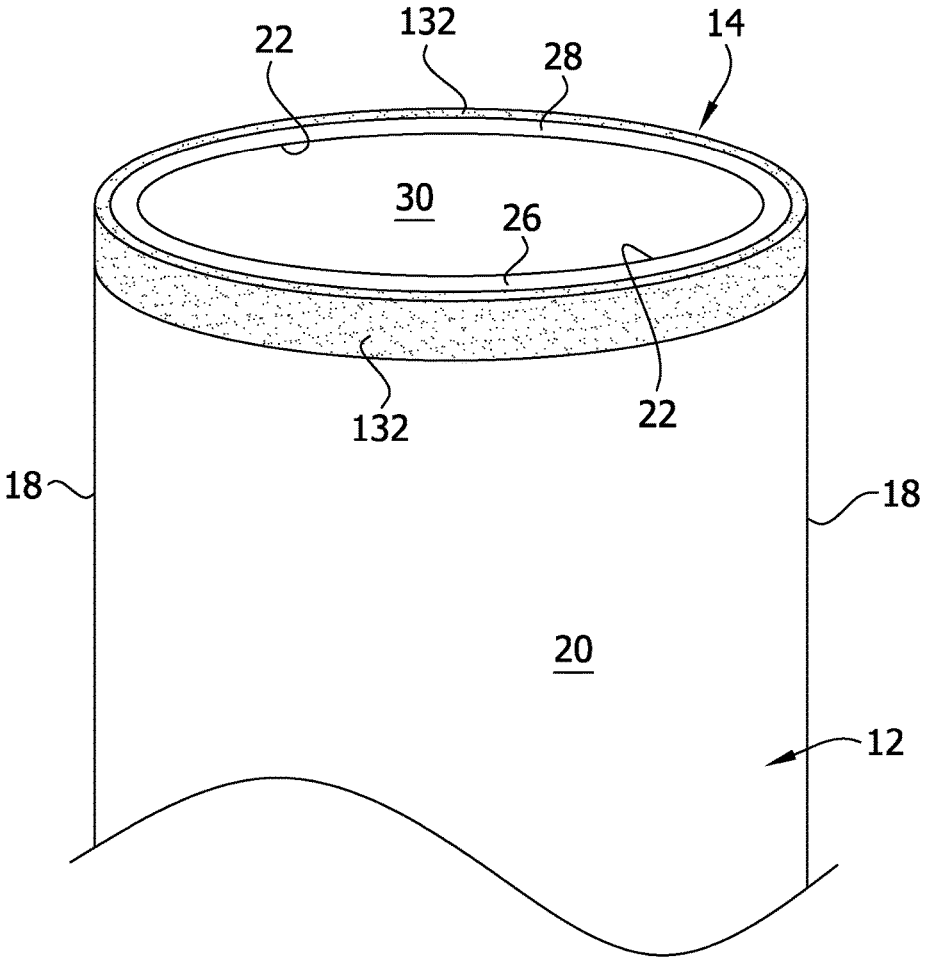
FIG. 7 is a fragmentary perspective of the plastic bag of FIG. 6.
Figure 8:
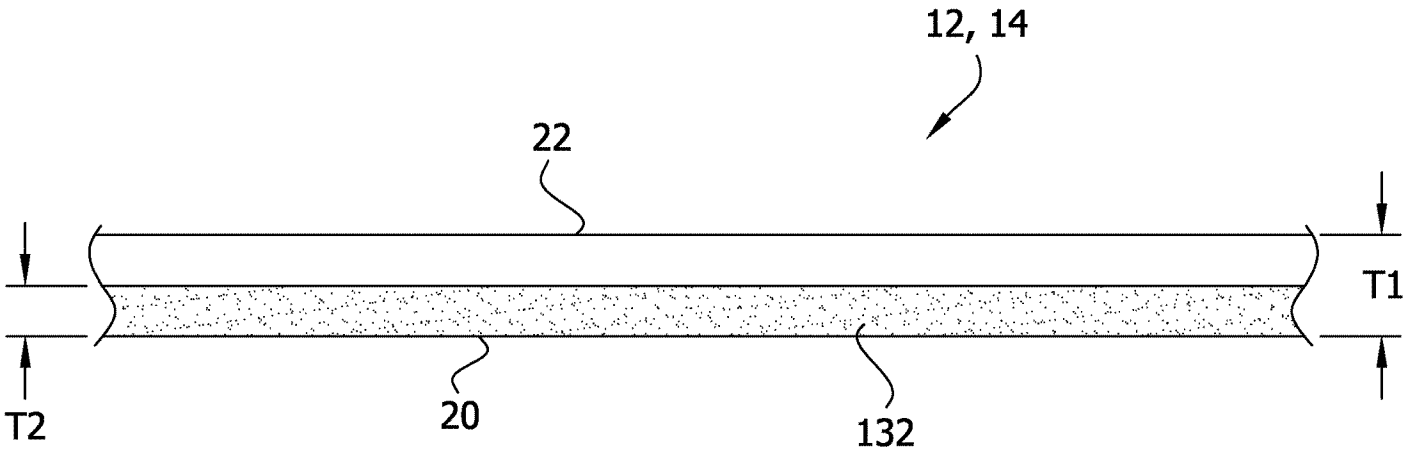
FIG. 8 is a fragmentary cross section of a panel of the plastic bag of FIG. 6, illustrating the grip strip extending partially through a thickness of the panel.
Figure 10:
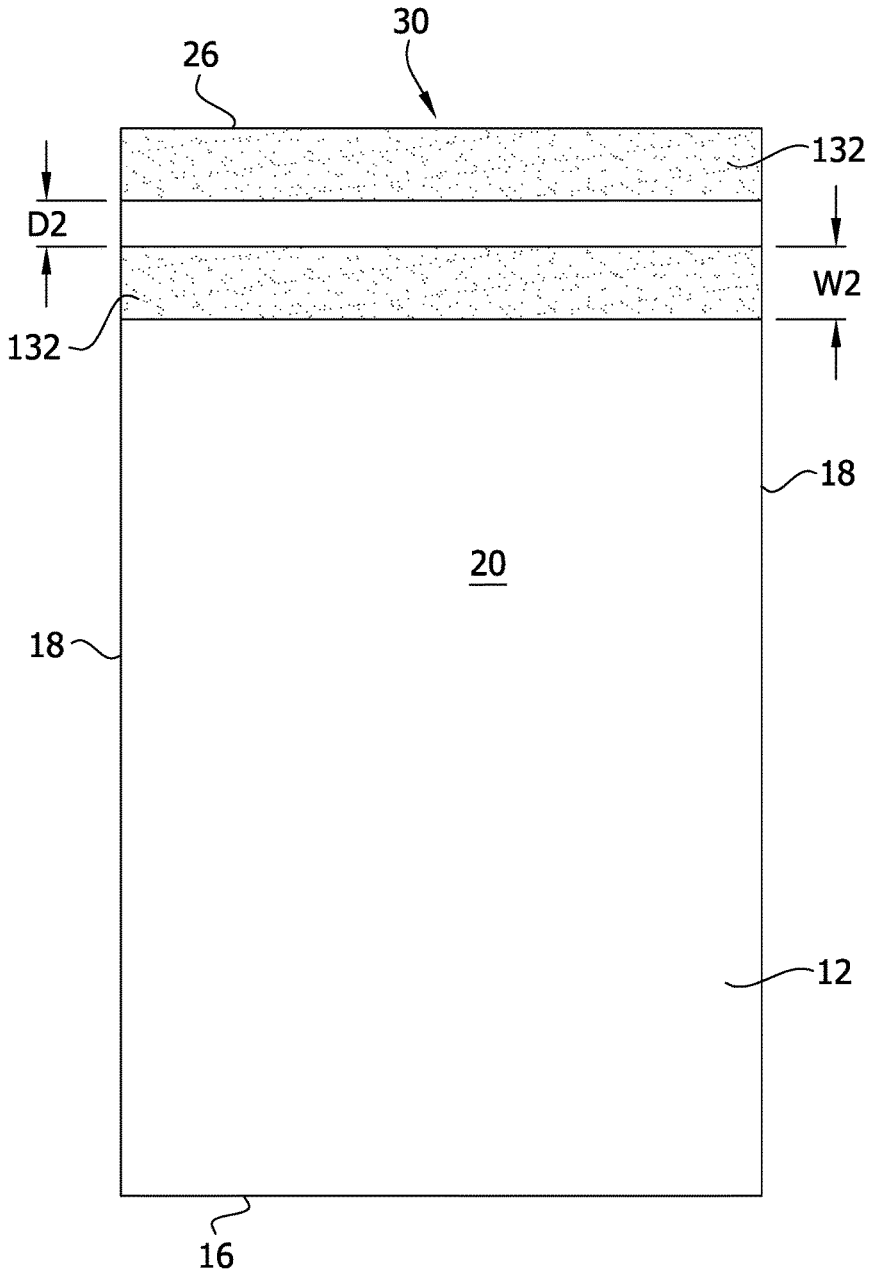
FIG. 10 is a front elevation of a plastic bag having two horizontal grip strips according to an embodiment of the present invention.

In the embodiment illustrated in FIGS. 6-8, grip strip(s) 132 extend horizontally across each panel 12, 14 between the sides 18 of the bag 10. FIG. 6 is a front elevation illustrating a portion of the front panel of the plastic bag as curled away from the rear panel for easy opening of the bag. The grip strip 132 is identical in material to the grip strip 32 described above. The grip strip 132 is relatively tacky or sticky as compared to the remainder of the bag 10, which is relatively smooth in comparison. The relatively smooth remainder of the bag 10 has a relatively low COF as compared to the grip strip 132, which has a higher COF to improve grip. As illustrated, at least one of the panels 12, 14 includes at least one grip strip 132 on the outer surface 20 of the panel. Each of the panels 12, 14 can include any desired number of grip strips. For example, each panel 12, 14 can include one grip strip 132 (see FIGS. 6 and 7), two strips (see FIG. 10), three strips, or any other suitable number of grip strips. Each strip 132 preferably has a width W2 in a range of about 0.25 inches to about 5 inches, such as from about 0.5 inches to about 2.5 inches. If the panel includes multiple strips 132, the strips can be spaced from each other by a distance D2 in a range of about 1 inch to about 10 inches, such as from about 2 inches to about 5 inches.

In the illustrated embodiment, the first panel 12 has the same number of grip strips 132 as the second panel 14, and each strip on the first panel is aligned with a strip on the second panel. However, other configurations are within the scope of the present invention. For example, the panels 12, 14 can have different numbers of grip strips 132, the grip strips on the panels can be staggered from each other, or only one of the panels can include a grip strip. As illustrated, each horizontal grip strip 132 extends along the entire width of the panels 12, 14 between the sides 18 of the bag 10, from left edge to right edge. However, the horizontal grip strip 132 may extend over only a portion of the width of the panels 12, 14 within the scope of the present invention. Preferably, the grip strip 132 extends to the top edges 26, 28 and is immediately adjacent the opening 30. In one preferred embodiment, the edge of the grip strip is coterminous with the edge of the bag and the edge that defines the opening.

As seen in FIG. 8, each grip strip 132 extends partially through the thickness T1 of each panel 12, 14. The grip strip 132 has a thickness T2 extending from the outer surface 20 toward the inner surface 22 of each panel 12, 14. In one embodiment, the thickness T1 is in a range of about 5 μm to about 20 μm, and the thickness T2 of the grip strip 132 is in a range of about 30% to about 90% of T1, such as between about 45% and about 75% of T1. In one embodiment, T1 is about 8 μm and T2 is about 5 μm.

The plastic bag 10 is preferably made from a thermoplastic material comprising ethylene-based polymers, such as high-density polyethylene (HDPE), although other suitable materials are within the scope of the present invention. As noted, the plastic bag 10 includes at least one relatively tacky strip 32, 132 and a relatively smooth surface of the remainder of the bag, the relatively smooth surface having a relatively low COF. The grip strip 32, 132 preferably is made of a material with a higher coefficient of friction than the remainder of the bag. The grip strip is preferably made from a polyethylene of lower density than the HDPE used to make the remainder of the bag; for example the grip strip comprises or is made from a material such as low density polyethylene (LDPE), linear low density polyethylene (LLDPE), ethylene copolymers [such as ethylene vinyl acetate copolymer], or metallocene polyethylene or ethylene copolymer. Examples of suitable metallocene lower density polyethylenes or ethylene copolymer include VISTAMAXX sold by Exxon Mobil, AFFINITY sold by The Dow Chemical Company, and ENGAGE sold by the Dow Chemical Company. For example, in one embodiment the smooth portions of the bag are made from HDPE film having a density of greater than about 0.935 g/cm$^3$, and the grip strips 32, 132 are made from low density polyethylene having a density below about 0.935 g/cm$^3$.

Using polyethylenes having different densities provide portions of varying coefficients of friction (COF). Typically, the COF of the smooth portions is less than about 0.3 or from about 0.1 to about 0.3 (e.g., about 0.1). The COF of the grip strip(s) is at least about 0.5 or from about 0.5 to about 1.0. These varying coefficients of friction can also be manifest by the relative COFs of the inner and outer surfaces. For example, typically the ratio of the COF of the grip strips to the smooth portions is at least 1:1, more typically at least about 1.5:1 (e.g., about 2:1).

As an alternative to using polyethylenes having different densities, the relatively smooth surface and relatively tacky surface can be imparted by incorporating one or more surface modification agents into the film used to prepare the plastic bag 10. Suitable surface modification agents for this purpose include slip additives and anti-block additives for the smooth surface and tackifiers for the tacky grip strip. In this manner, the relatively smooth portions and relatively tacky portions of the films used to construct the plastic bag are modified by virtue of the presence of one or more components (i.e., are chemically modified). However, using polyethylenes having different material properties as described is preferred.

The grip strips 32, 132 are co-extruded with the panels 12, 14. The grip strips are made of a material (i.e., ethylene-based polymer having a lower density, as described above) which is different from the material of the panels 12, 14, which is essentially embedded in the material for the panels 12, 14 for co-axial extrusion. The process includes extruding two or more materials through a single die with two or more orifices arranged so that the extrudates merge and weld together into a laminar structure before chilling. Co-extrusion can be employed in film blowing. The advantage of co-extrusion is that each ply of the laminate imparts a desired characteristic property, such as stiffness, heat-sealability, impermeability or resistance to some environment, all of which properties would be impossible to attain with any single material.

The grip strips 32, 132 permit easy opening of the plastic bag 10. A user can grasp the bag 10 on the strips 32, 132 and use the strips to move the first and second panels 12, 14 relative to each other to open the bag. The user can easily grip the outer surface 20 of each panel 12, 14 at the grip strip 32, 132 and twist (or move the panels in opposing directions) to open the bag. The grip strips 32, 132 provide a surface the user can easily grip to create relative movement between the panels, as opposed to the smooth surface of the remainder of the bag that is not easily gripped.

Furthermore, because of the material differences between the smooth surfaces of the remainder of the bag and the grip strip 32, 132 in one embodiment of the invention, the top edges 26, 28 of the panels curl outward away from each other to facilitate opening of the bag 10. In particular, the HDPE film used to form the major panels of the bag is of higher crystallinity and has a faster crystallization speed than the lower density polyethylene material used to make the grip strip segment. For example, in one embodiment the HDPE film used to form the major panels of the bag preferably has a degree of crystallinity of at least 70%, and the lower density polyethylene material used to make the grip strip preferably has a degree of crystallinity of less than 70%. In one embodiment, the HDPE film has a degree of crystallinity in a range of about 70-80% and the lower density polyethylene grip strip has a degree of crystallinity of less than 60%, for example 45-55%. Thus, shortly after the film blowing co-extrusion process, the HDPE film reaches its equilibrium state after which the dimension of the HDPE film does not change. Since the lower density polyethylene used to form the grip strips 32, 132 has a lower crystallinity and a slower crystallization speed, its dimensions continue to change—i.e., it continues to shrink—even after the HDPE material to which it is bonded has reached equilibrium and ceased changing. This differential imparts internal stress to the composite film. When the top of the bag is liberated by cutting or tearing at the bag opening, the internal stress relaxes and, as seen in FIGS. 4 and 9, the shrinking of the grip strips 32, 132 causes the top edges 26, 28 of the bag 10 to curl outward away from each other.

The degree of crystallization depends on the material components. For example, in one aspect it depends on the alpha-olefin content (i.e., short-chain branch). For HDPE, butene-alpha olefin is used for copolymerization and its alpha-olefin content is low which results in a high degree of crystallization. LLDPE has higher content of alpha-olefin; so the degree of crystallization is lower than HDPE. The crystallization temperature (peak) is about 8~10° C. below melt temperature. For example, with a 125° C. melt temperature for hexene-LLDPE, the crystallization temperature is about 117~115° C. In addition, one skilled in the art well understands that processing conditions affect the the degree of crystallization and crystallization temperature. For pure HDPE, the % of crystallization is about 70-80%. In contrast, the degree of crystallization for pure LDPE is about 45-55%. LLDPE has a degree of crystallization between these two. And blending different types of resin such as LLDPE/LDPE or LLDPE/HDPE can be used to control the degree of crystallization. As a general proposition, the crystallization rate is too fast to be quantified for polyethylene. However, the invention in one aspect can be described and then recognized in terms of relative rates of crystallization without actually quantifying the rates. This relieves the assessor of having to be concerned about under what conditions—e.g., from what temperature to what temperature, in what atmosphere, etc.—the rates of crystallization are to be measured. Rather, one skilled in the art will understand that in this aspect the invention involves a co-extruded grip strip material which has a crystallization speed which is different from, preferably slower than, a crystallization speed of the panel material; and the relevant conditions are those conditions under which the co-extrusion occurs and under which the bag is cooled, and the those conditions are not narrowly critical to this embodiment of the invention, provided the above-described conditions of internal stress are imparted.

Figure 4:
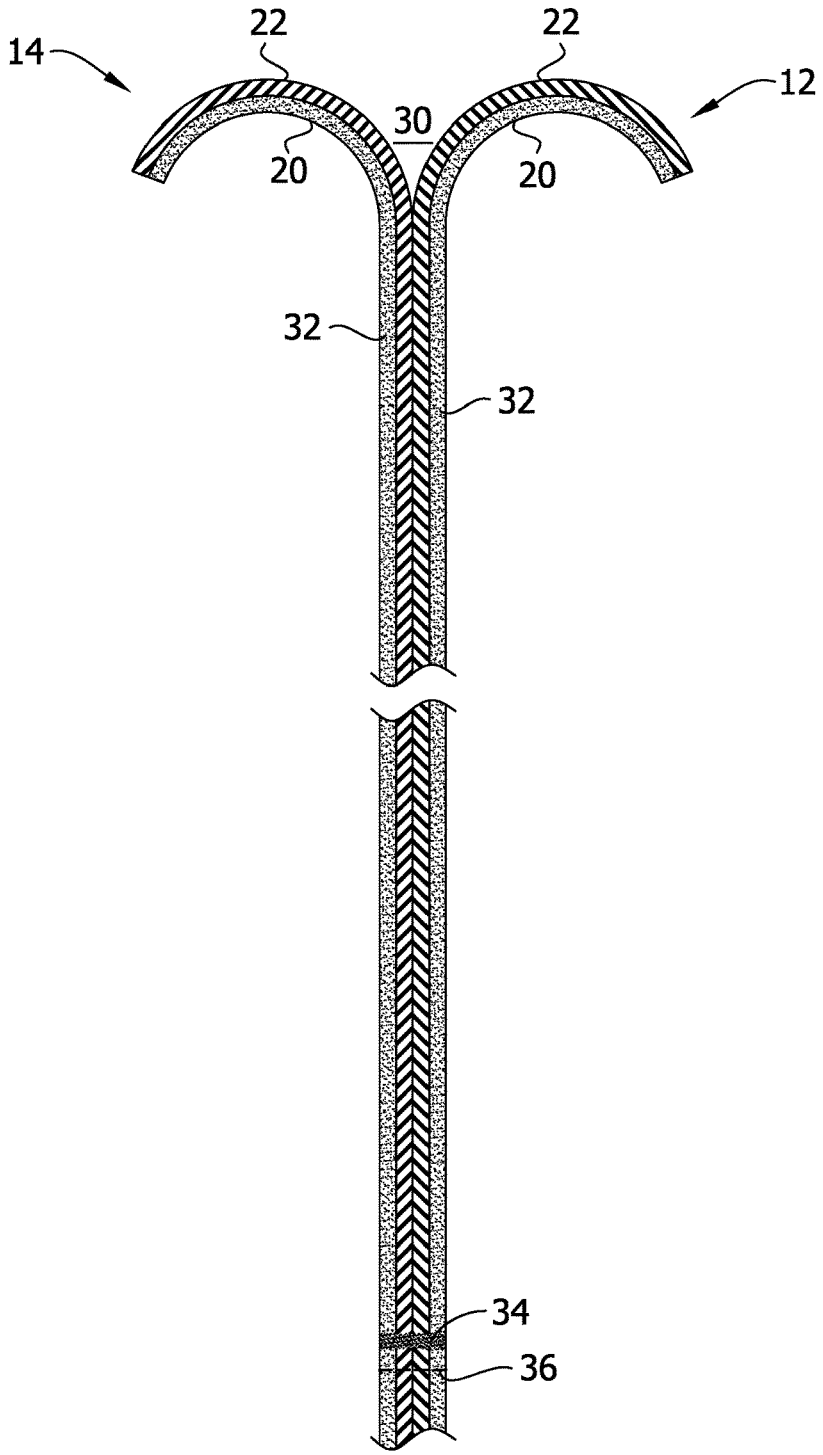
FIG. 4 is a fragmentary cross section of the plastic bag, illustrating the front and rear panels curled away from each other for easy opening of the bag.
Figure 5:
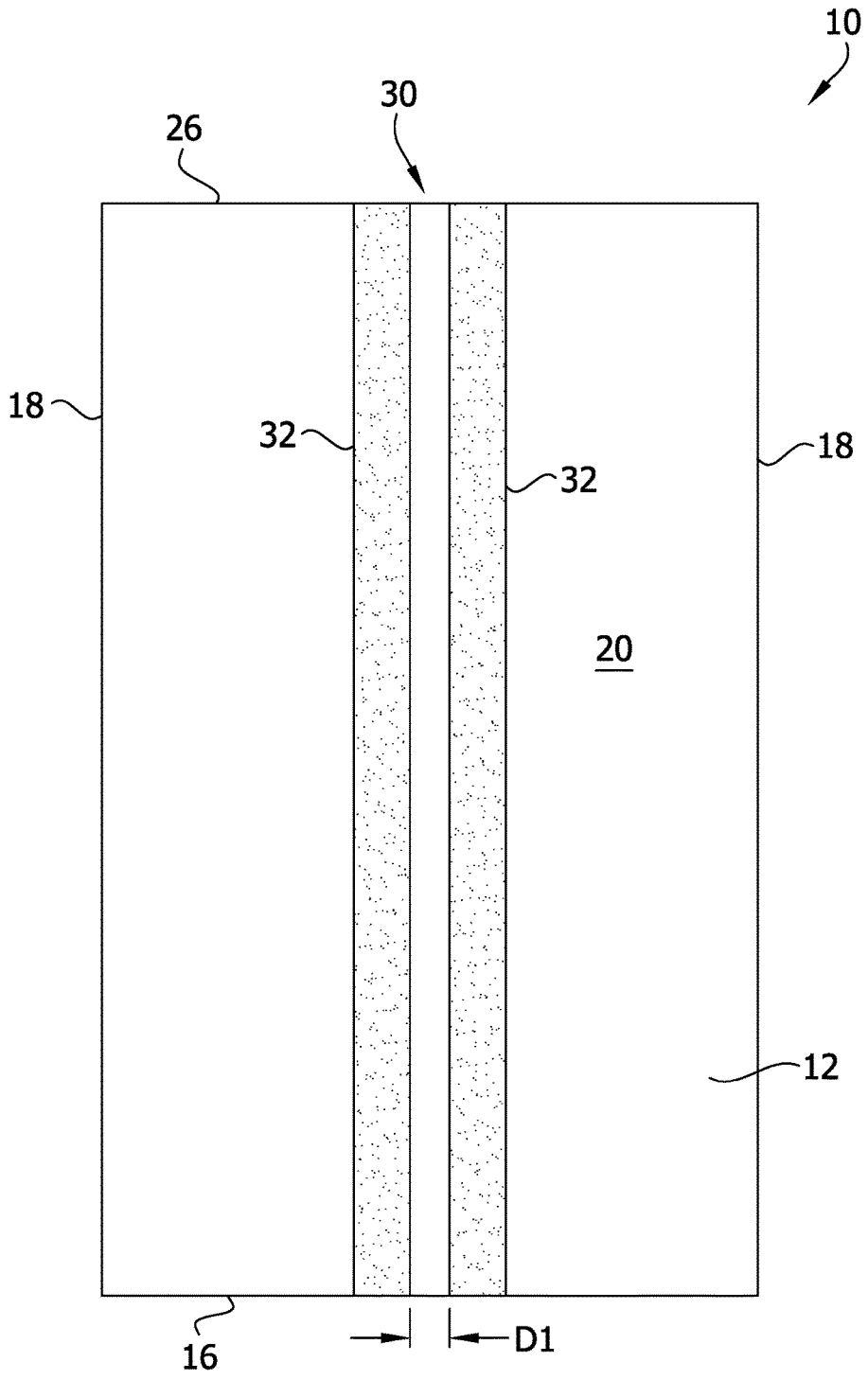
FIG. 5 is a front elevation of a plastic bag having two vertical grip strips according to an embodiment of the present invention.
Figure 9:
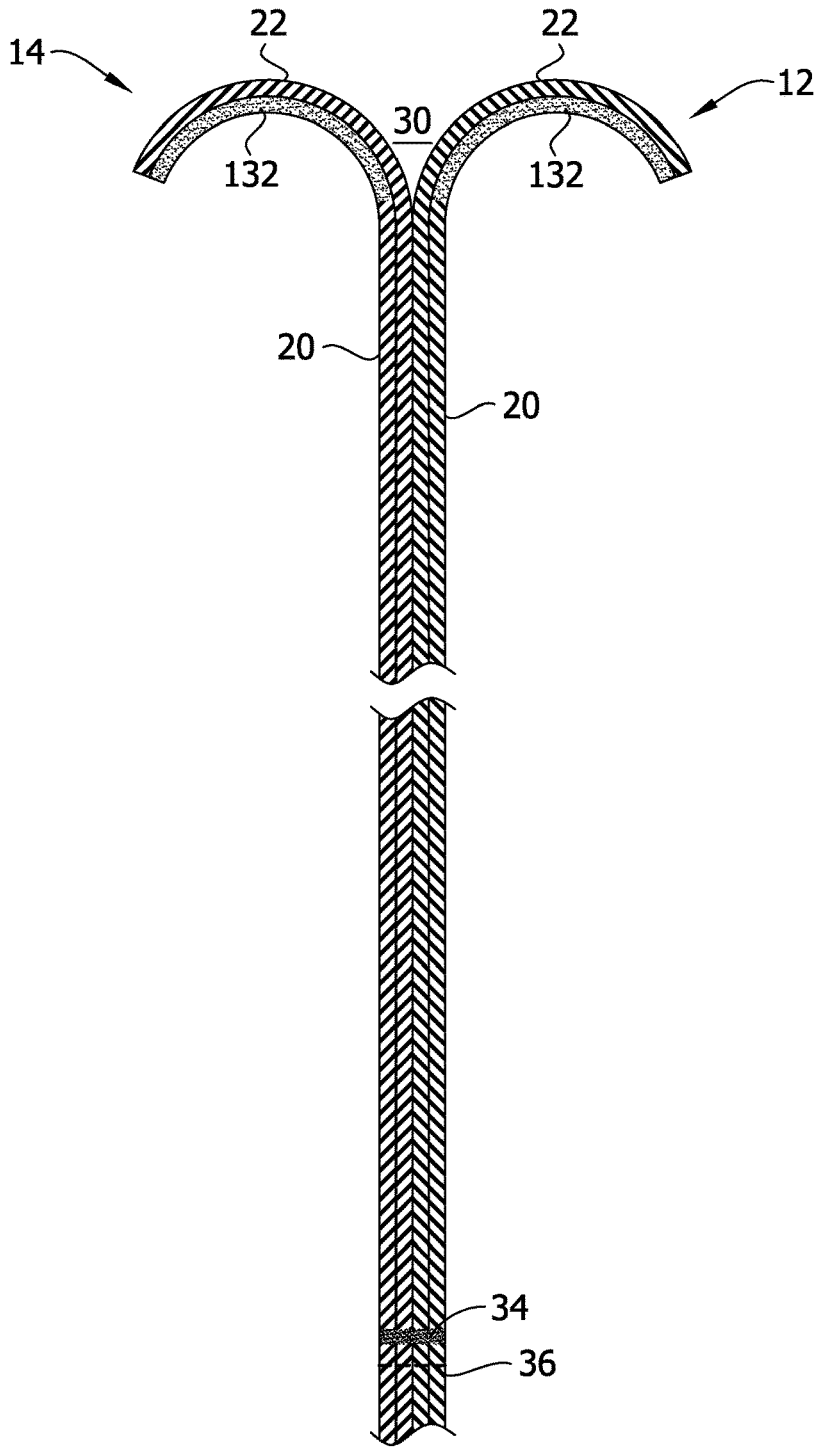
FIG. 9 is a fragmentary cross section of the plastic bag, illustrating the front and rear panels curled away from each other for easy opening of the bag.

As seen in FIGS. 4 and 9, multiple bags 10 can be formed by a blown film co-extrusion process and then sealed at 34 and perforated at 36. To use a bag, a user tears the film at the perforation 36 to remove a single bag from the remainder of the bags formed together. Upon tearing the film at the perforation 36, the top edges 26, 28 of the single bag 10 are no longer connected, and the internal stresses within the opposite panels 12, 14 no longer cancel each other out. Thus, upon tearing the film to remove a single bag, the panels 12, 14 will begin to curl outward from each other due to the stress relaxation in the grip strips 32, 132. The user can then easily identify the opening 30 of the bag 10 and can easily open the bag.

Figure 11:
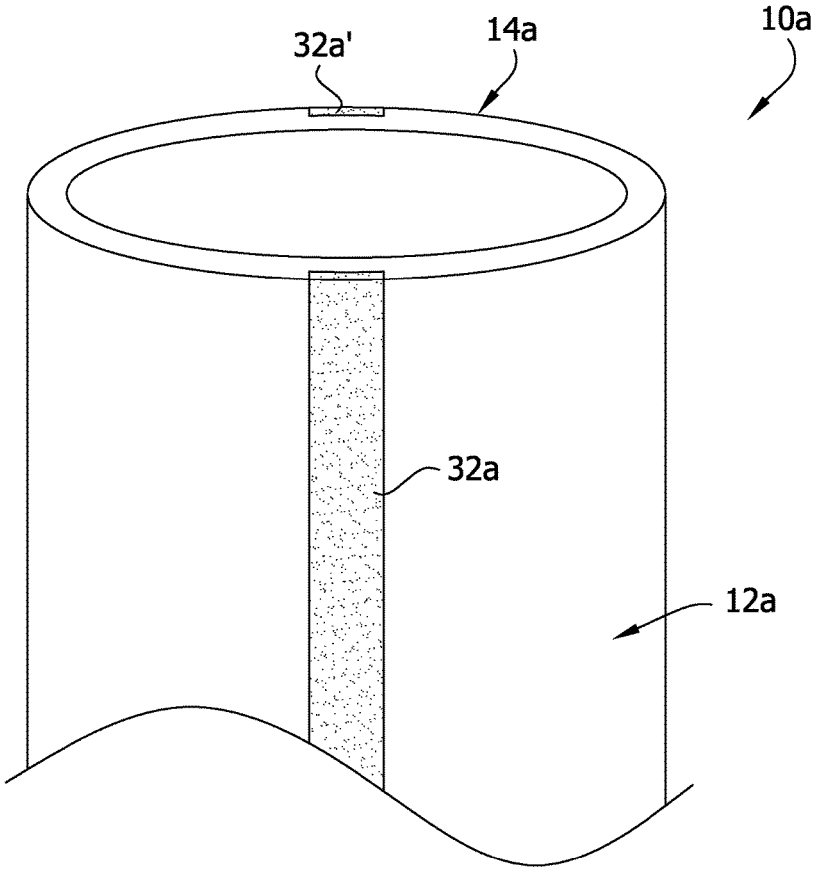
FIG. 11 is a fragmentary perspective of a plastic bag having a vertical grip strip on a front panel and a vertical grip strip on a rear panel aligned with the grip strip on the front panel according to an embodiment of the present invention.
Figure 12:
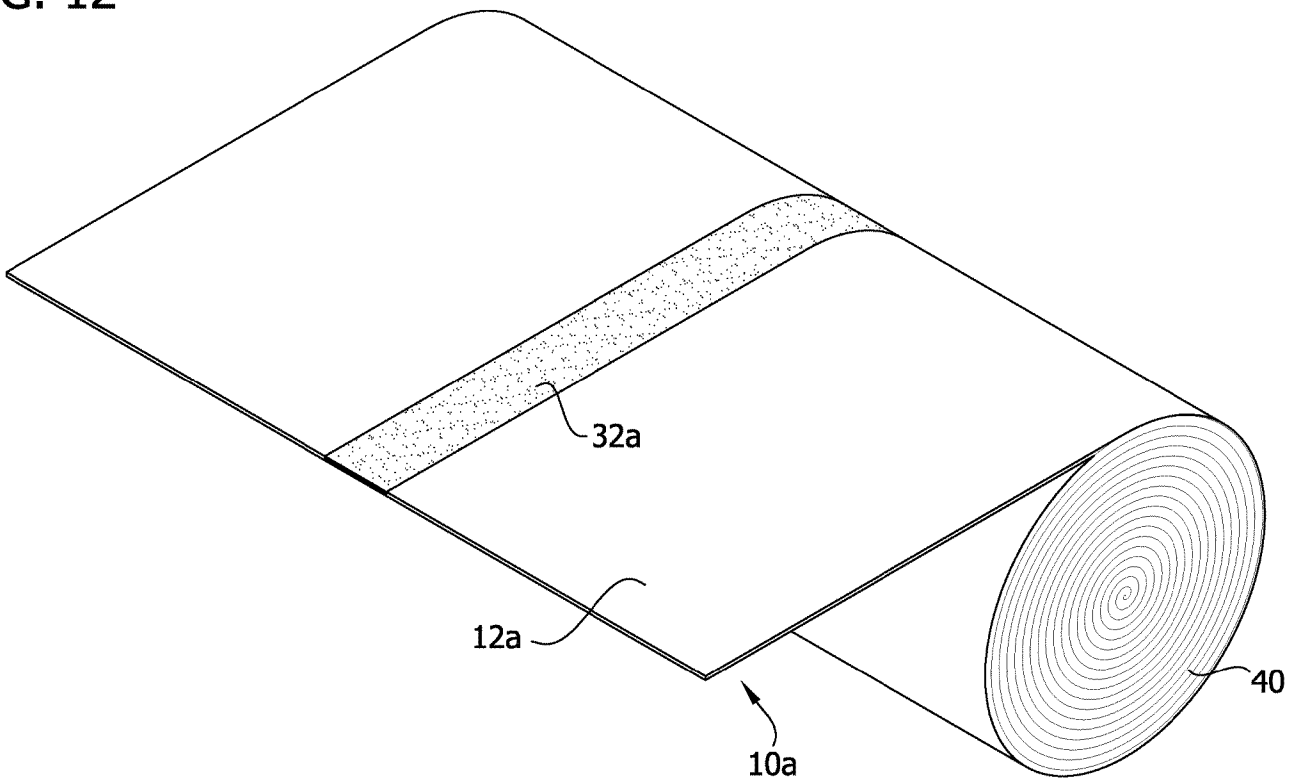
FIG. 12 is a perspective of multiple bags as shown in FIG. 11 rolled together to form a bag roll.
Figure 13:
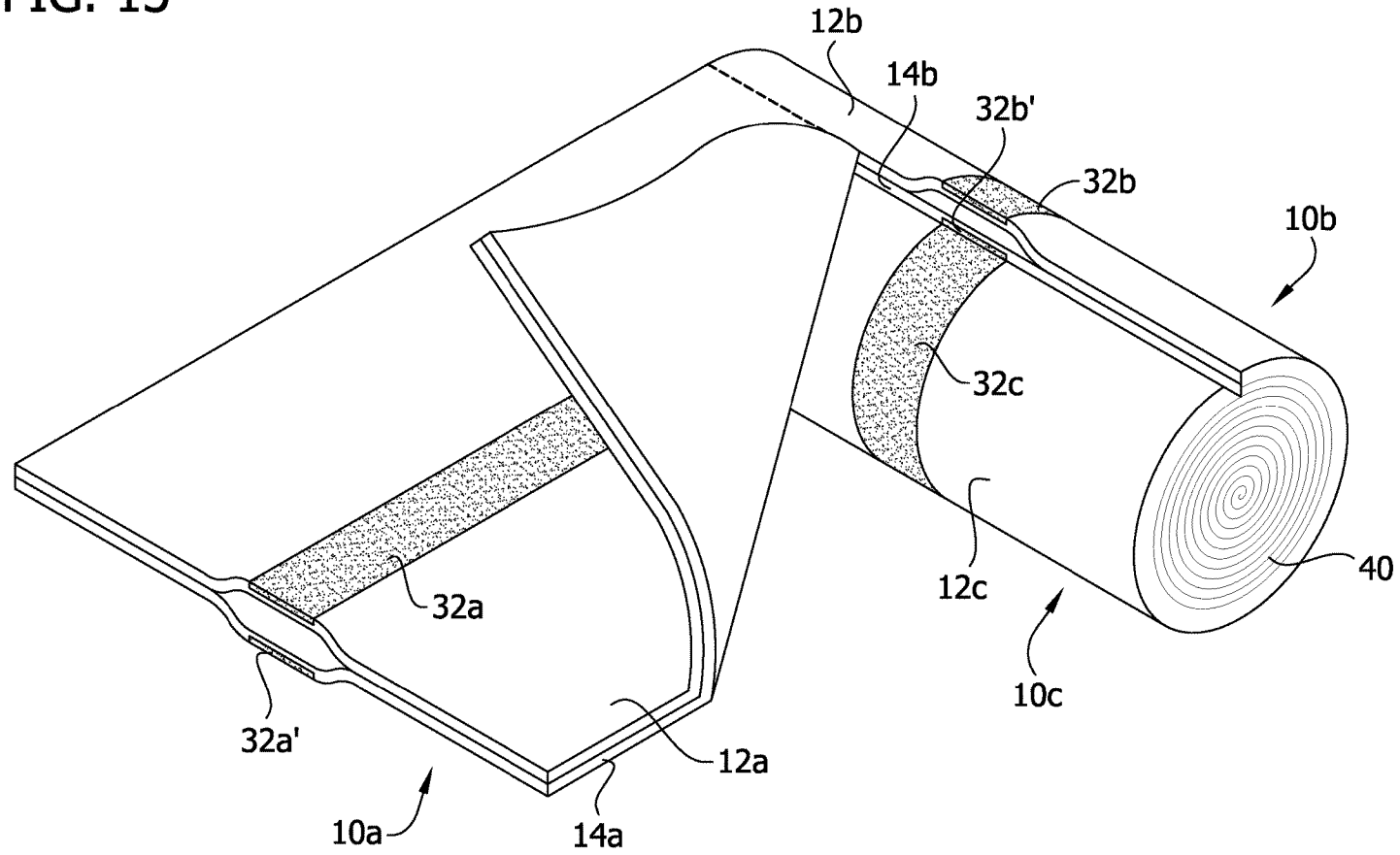
FIG. 13 is a perspective of the bag roll of FIG. 12 illustrating a first bag being torn away from the remainder of the bag roll causing the next bag to open.
Figure 14:
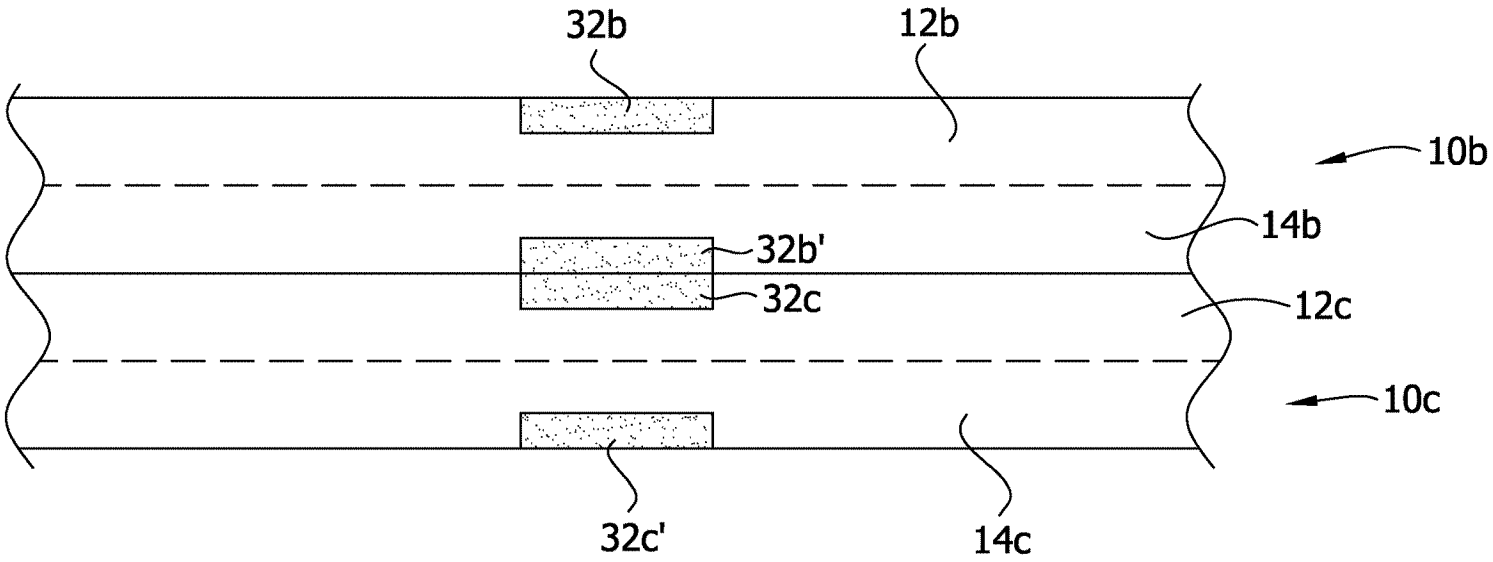
FIG. 14 is a fragmentary cross section of two plastic bags in the bag roll of FIG. 12 illustrating the grip strips of the bags overlying and engaging each other.

As seen in the embodiment illustrated in FIGS. 11-14, multiple bags 10 can be formed by a blown film co-extrusion process, sealed and perforated as described above, and rolled together to form a bag roll 40. As illustrated, each bag 10 in the bag roll 40 includes a vertical grip strip 32 on the front panel 12 and a vertical grip strip 32 on the rear panel aligned with the grip strip on the front panel. However, it is understood that the bags in the bag roll can have a different number or configuration of grip strips, such as in the embodiments described above. As seen in FIG. 11, a first bag 10*a* in the bag roll 40 includes a vertical grip strip 32*a* on the front panel 12*a* and a vertical grip strip 32*a*' on the back panel 14*a*. Likewise, as seen in FIGS. 13 and 14, a second bag 10*b* in the bag roll 40 includes a grip strip 32*b* on the front panel 12*b* and a grip strip 32*b*' on the back panel 14*b*, and a third bag 10*c* includes a grip strip 32*c* on the front panel 12*c* and a grip strip 32*c*' on the back panel 14*c*. When multiple bags 10*a*, 10*b*, 10*c* are rolled to form the bag roll 40, the grip strips 32 of each bag align with each other. As seen in FIG. 13, when bag 10*a* is pulled outward and upward to tear the bag at the perforation 36, an upward force is imparted on the next bag 10*b* in the bag roll 40. This upward force causes the front panel 12*b* of the bag 10*b* to lift upward away from the back panel 14*b* of the bag. The back panel 14*b* of the bag 10*b* does not lift upward because of the alignment of the grip strip 32*b*' with the grip strip 32*c* on the front panel 12*c* of the third bag 10*c*.

FIG. 14 illustrates the alignment of the grip strips 32*b*' and 32*c* on the bags 10*b* and 10*c*. The grip strip 32*b*' on the back panel 14*b* of the outer bag 10*b* overlies and engages the grip strip 32*c* on a front panel 12*c* of the inner bag 10*c*. The grip strips 32*b*' and 32*c* engage each other with a higher bond strength than the remainder of the panels. Thus, because of the engagement of the grip strips, the panels 14*b*, 12*c* will remain stuck together even as an upward force is applied to the bag 10*b* upon the removal of bag 10*a*, whereas the front panel 12*b* is separated from the back panel 14*b*. Removal of the bag 10*a* therefore causes the next bag 10*b* to open as the front panel 12*b* of the next bag is lifted upward and the rear panel 14*b* remains in place against the remainder of the bag roll 40.

In other embodiments, each bag 10 may only include one grip strip 32, or the grip strips of overlying bags may not align with each other. The grip strip 32 of one bag will have a higher bond strength even with the smooth portion of another bag relative to the bond strength of two smooth portions together. Thus, even a bag with only one grip strip on the surface facing the remainder of the bag roll would be opened by removal of a preceding bag.

The grip strips 32, 132 therefore permit easy opening of the bag 10 in multiple ways. A user can easily grip the grip strips 32, 132 to move the panels 12, 14 relative to each other to open the bag 10. The material differences in the smooth portions of the bag 10 and the grip strips 32, 132 cause the panels 12, 14 to curl outward away from each other so that the user can easily identify the opening 30 of the bag and easily open the bag. And removal of one bag 10 from a bag roll 40 causes the front panel 12 of the next bag to lift upward while the grip strip 32, 132 causes the back panel 14 of the next bag to remain in place, thereby allowing the user to easily identify the opening 30 of the bag and easily open the bag.

The bag 10 can include different colored portions to provide information to the user about the location of the grip strips 32, 132. In one embodiment, the grip strip 32, 132 is a different color than the panels 12, 14. This displays to a user the location of the grip strip 32, 132, which indicates where the user should grasp the bag 10 to open the bag.

Having described the invention in detail, it will be apparent that modifications and variations are possible without departing from the scope of the invention defined in the appended claims.

When introducing elements of the present invention or the preferred embodiments(s) thereof, the articles "a", "an", the and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A plastic bag comprising:

a first panel having a bottom edge, first and second side edges, and a top edge, with the first panel bottom edge and top edge being opposite each other and the first panel first and second side edges being opposite each other, the first panel further having an inner surface and an opposite outer surface;

a second panel having a bottom edge, first and second side edges, and a top edge, with the second panel bottom edge and top edge being opposite each other and the second panel first and second side edges being opposite each other, the second panel further having an inner surface and an opposite outer surface, the first and second panels being joined to each other along the respective bottom edges and first and second side edges so that the inner surfaces define a bag interior, the first and second panels defining an opening between the respective top edges permitting access to the bag interior; and at least one of the first and second panels including a major portion and a grip strip portion configured to assist with opening the bag, wherein the grip strip portion is co-extruded with the major portion of its associated panel so that the outer surface of the respective panel is substantially flat and extends continuously across the grip strip portion and a transition region between the major portion and the grip strip portion;

wherein the grip strip portion is formed from a grip strip material different from a major portion material from which the major portion of its associated panel is formed; and wherein the co-extruded strip material has a coefficient of friction which is greater than a coefficient of friction of the major portion material of its associated panel.

2. The plastic bag of claim 1 wherein the co-extruded grip strip material has a degree of crystallinity lower than a degree of crystallinity of the major portion material.

3. The plastic bag of claim 2 wherein the co-extruded grip strip material has a degree of crystallinity less than about 60% and the major portion material has a degree of crystallinity of at least about 70%.

4. The plastic bag of claim 1 wherein the co-extruded strip material has an internal stress which biases the bag opening toward an open position.

5. The plastic bag of claim 4 wherein the internal stress of the co-extruded strip material causes the top edges of the first and second panels to curl away from each other to permit access to the bag interior through the opening.

6. The plastic bag of claim 1 wherein a ratio of a coefficient of friction of the grip strip material to a coefficient of friction of the major portion material is at least about 1.5:1.

7. The plastic bag of claim 1 wherein the ratio of the coefficient of friction of the grip strip material to the coefficient of friction of the major portion material is about 2:1.

8. The plastic bag of claim 1, wherein the coefficient of friction of the major portions of the first and second panels is in a range of about 0.1 to about 0.3 and the coefficient of friction of the grip strip portion is in a range of about 0.5 to about 1.0.

9. The plastic bag of claim 1, wherein the major portion comprises a high density polyethylene, and the grip strip portion comprises a polyethylene or an ethylene copolymer of lower density.

10. The plastic bag of claim 1, wherein the grip strip portion extends from one of said edges to an opposite of said edges.

11. The plastic bag of claim 1, wherein the first panel has a co-extruded first grip strip portion and the second panel has a co-extruded second grip strip portion.

12. The plastic bag of claim 1, wherein the grip strip portion extends vertically along the first panel from the top edge to the bottom edge or horizontally along the first panel adjacent the top edge from the first side edge to the second side edge.

13. The plastic bag of claim 12, wherein each of the first and second panels includes a plurality of grip strip portions at spaced locations.

14. The plastic bag of claim 1 wherein the co-extruded grip strip material has a crystallization speed which is different from a crystallization speed of the major portion material.

15. A plastic bag comprising:

a first panel and a second panel joined together along a first side edge, a second side edge, and a bottom edge to define a bag interior, each of the first and second panels having a top edge, the first and second panels defining an opening between the respective top edges permitting access to the bag interior, each of the first and second panels having an inner surface, an outer surface, and a thickness extending between the inner and outer surfaces and including a major portion and at least one grip strip portion having a coefficient of friction higher than a coefficient of friction of the major portion of the panel, the at least one grip strip portion extending vertically along the panel from the top edge to the bottom edge, or horizontally along the panel adjacent the top edge from the first side edge to the second side edge, and the at least one grip strip portion extending through between 30% and 90% of the thickness of the respective panel;

wherein the outer surface of the respective panel is substantially flat and extends continuously across the at least one grip strip portion and a transition region between the major portion and the grip strip portion.

16. The plastic bag of claim 15, wherein the first panel includes a plurality of grip strip portions at spaced apart locations, and the second panel includes a plurality of grip strip portions at spaced apart locations, the grip strip portions on the first and second panels being aligned with each other.

17. The plastic bag of claim 15, wherein the coefficient of friction of the major portions of the first and second panels is in a range of about 0.1 to about 0.3 and the coefficient of friction of the grip strip portions is in a range of about 0.5 to about 1.0.

18. The plastic bag of claim 17, wherein the density of the major portions of the first and second panels is at least 0.935 g/cm$^3$ and the density of the at least one grip strip is below 0.935 g/cm$^3$.

19. The plastic bag of claim 15 wherein the at least one grip strip portion extends horizontally along the panel adjacent the top edge from the first side edge to the second side edge.

20. The plastic bag of claim 17, wherein the major portions of the first and second panels comprise a high density polyethylene, and the grip strip portion comprises a polyethylene or ethylene copolymer of lower density.

21. A bag roll comprising:

a plurality of bags connected end-to-end and rolled together in a roll, each bag in turn comprising:

a first panel having a bottom edge, first and second side edges, and a top edge, with the first panel bottom edge and top edge being opposite each other and the first panel first and second side edges being opposite each other;

a second panel having a bottom edge, first and second side edges, and a top edge, with the second panel bottom edge and top edge being opposite each other and the second panel first and second side edges being opposite each other, the first and second panels being joined to each other along the respective bottom edges and first and second side edges to define a bag interior, the first and second panels defining an opening between the respective top edges permitting access to the bag interior; and at least one of the first and second panels including a grip strip to assist with opening the bag, wherein the grip strip is co-extruded with the associated panel and the grip strip is formed from a material different from a material from which the associated panel is formed, wherein the grip strip is configured to assist with opening the bag, and wherein the outer surface of the respective panel which extends continuously across the grip strip portion and a transition region between the major portion and the grip strip portion is substantially flat;

wherein the roll comprises a leading outer bag, a trailing outer bag, and an inner bag, wherein the leading outer bag is a bag which is first accessible, the trailing outer bag is a bag behind the leading outer bag, and the inner bag is a bag behind the trailing outer bag, wherein a grip strip on one of the trailing outer bag and the inner bag engages the other of the trailing outer bag and the inner bag such that when the leading outer bag is pulled upward with an upward force, the trailing outer bag opens.

* * * * *